US005827050A

United States Patent [19]

Price

[11] Patent Number: 5,827,050

[45] Date of Patent: Oct. 27, 1998

[54] JUG HEAT PAK

[76] Inventor: Gregory W. Price, 8357 Kavanagh Rd., Baltimore, Md. 21222

[21] Appl. No.: 689,498

[22] Filed: Aug. 7, 1996

[51] Int. Cl.[6] ..... F04B 19/24; F25B 45/00; H05B 3/34; F24H 1/18

[52] U.S. Cl. ..... 417/207; 62/77; 62/149; 62/292; 219/528; 392/459

[58] Field of Search ..... 417/207; 62/292, 62/149, 77; 219/529; 392/458, 459

[56] References Cited

U.S. PATENT DOCUMENTS

| | | | |
|---|---|---|---|
| 3,079,486 | 2/1963 | Winchell | 219/529 |
| 3,484,585 | 12/1969 | Morey | 219/529 |
| 4,833,299 | 5/1989 | Estes | 392/459 |
| 5,086,630 | 2/1992 | Van Steenburgh, Jr. | 62/475 |
| 5,195,333 | 3/1993 | Van Steenburgh, Jr. | 62/292 |
| 5,230,224 | 7/1993 | Ricketts et al. | 62/292 |
| 5,233,840 | 8/1993 | Scaringe | 62/292 |
| 5,243,832 | 9/1993 | Van Steenburgh, Jr. | 62/292 |
| 5,377,495 | 1/1995 | Daigle | 62/292 |
| 5,396,774 | 3/1995 | Hubbell, Jr. | 62/292 |
| 5,540,254 | 7/1996 | McGowan et al. | 62/77 |

OTHER PUBLICATIONS

Product Bulletin DH5M of Electro–Flex Heat, Inc., "Electro–Flex Flexible Drum and Pail Heaters," pp. 1–8.

*Primary Examiner*—Bibhu Mohanty
*Attorney, Agent, or Firm*—Milbank, Tweed, Hadley & McCloy

[57] ABSTRACT

A heating system for facilitating the transfer of gas from a portable cylinder in a safe and efficient manner.

14 Claims, 2 Drawing Sheets

JUG HEAT PAK

BACKGROUND OF THE INVENTION

The invention relates in general to an apparatus and method for the improved discharge of gas from containers through the controlled heating of the containers holding gas. More particularly, the invention relates to a heating jacket which is attached to a portable gas cylinder to assist, and in some cases permit, the transfer of gas.

Air conditioning and refrigeration technicians charge or refill refrigerant compressors throughout the year in all types of weather conditions. The charging process involves the transfer of a refrigerant from a portable cylinder to a compressor, which is typically stationary. As the ambient temperature is reduced the time to transfer the gas is increased. Occasionally the ambient temperature will be reduced to the point where the gas pressure in the transfer line will equalize with the gas pressure in the portable cylinder causing the flow of gas from the portable cylinder to the compressor to cease. This transfer inefficiency, or in some cases elimination, occurs in part because the pressure in the portable cylinder is a function of the temperature of the refrigerant gas therein. At lower ambient temperatures the refrigerant gas in the cylinder boils off at a slower rate and at lower pressures.

Technicians must find a way to transfer or facilitate the transfer of gas from a portable cylinder to a compressor during mild to cold temperature conditions. One solution is to heat the portable cylinder to increase the pressure of its contents so that the gas may be transferred to the compressor. For example, this may be accomplished by placing the portable cylinder in a container filled with warm water. This procedure is troublesome and becomes increasingly unproductive the greater the distance is between the compressor and the source of warm water. The problems associated with this solution are compounded by the unsafe conditions created by the uncontrolled nature of this heating method since no protection is provided against over-pressurization of the portable cylinder or transfer line between the portable cylinder and compressor.

Another prior art solution is referred to as liquid transfer. According to this method, the portable cylinder is inverted so that the liquid in the cylinder is gravity-transferred through the transfer line to the compressor. This procedure is disadvantageous because continued transfer by this method can cause premature failure of the suction and discharge valves in the compressor.

Prior art apparatus disclose the well known fact that the rate of gas transfer is related to the temperature of the material. For example, U.S. Pat. Nos. 5,086,630, 5,195,333, and 5,243,832, to Van Steenburgh, Jr. and U.S. Pat. No. 5,230,224, to Ricketts et al., utilize a variety of unit operations, such as pumps, compressors, and condensers, to prevent the release of refrigerant to the atmosphere. These devices do not solve the above-described problems and cannot be carried by a technician in the field as they do not provide a lightweight, portable device for heating the cylinder and safely controlling the transfer of material.

The foregoing demonstrates that there is a need for a simple, controlled method and apparatus to permit the efficient and safe transfer of gas from a portable cylinder.

SUMMARY OF THE INVENTION

The invention satisfies the need and avoids the drawbacks of the prior art by providing a heating device which facilitates the transfer of material from a portable cylinder in a safe and efficient manner. A flexible heating jacket is attached to a portable cylinder and controllably increases the temperature and thereby the pressure of the materials in the portable gas cylinder to a predetermined set point. The pressure is increased sufficiently to overcome the downstream pressure and gas is transferred from the cylinder.

The flexible heating jacket may be heated using a heating circuit which is powered by either alternating or direct current. Hence, the flexible heating jacket includes an AC adapter and a DC adapter engageable with a battery. The heating circuit may advantageously include a controller and a device for breaking the circuit if the temperature rises above a predetermined set point. The flexible heating jacket also includes attached compartments for storing a variety of facilitating elements. For example, one compartment may be useful for holding the battery. Another compartment may be designed for storing a hose connector, pressure gauge and a pressure relief valve. A unit for re-charging the battery may also be stored in a compartment. These facilitating elements may also be attached to the heating jacket or electrical cord by a clip or other known attachment devices.

DETAILED DESCRIPTION

Figure 1:
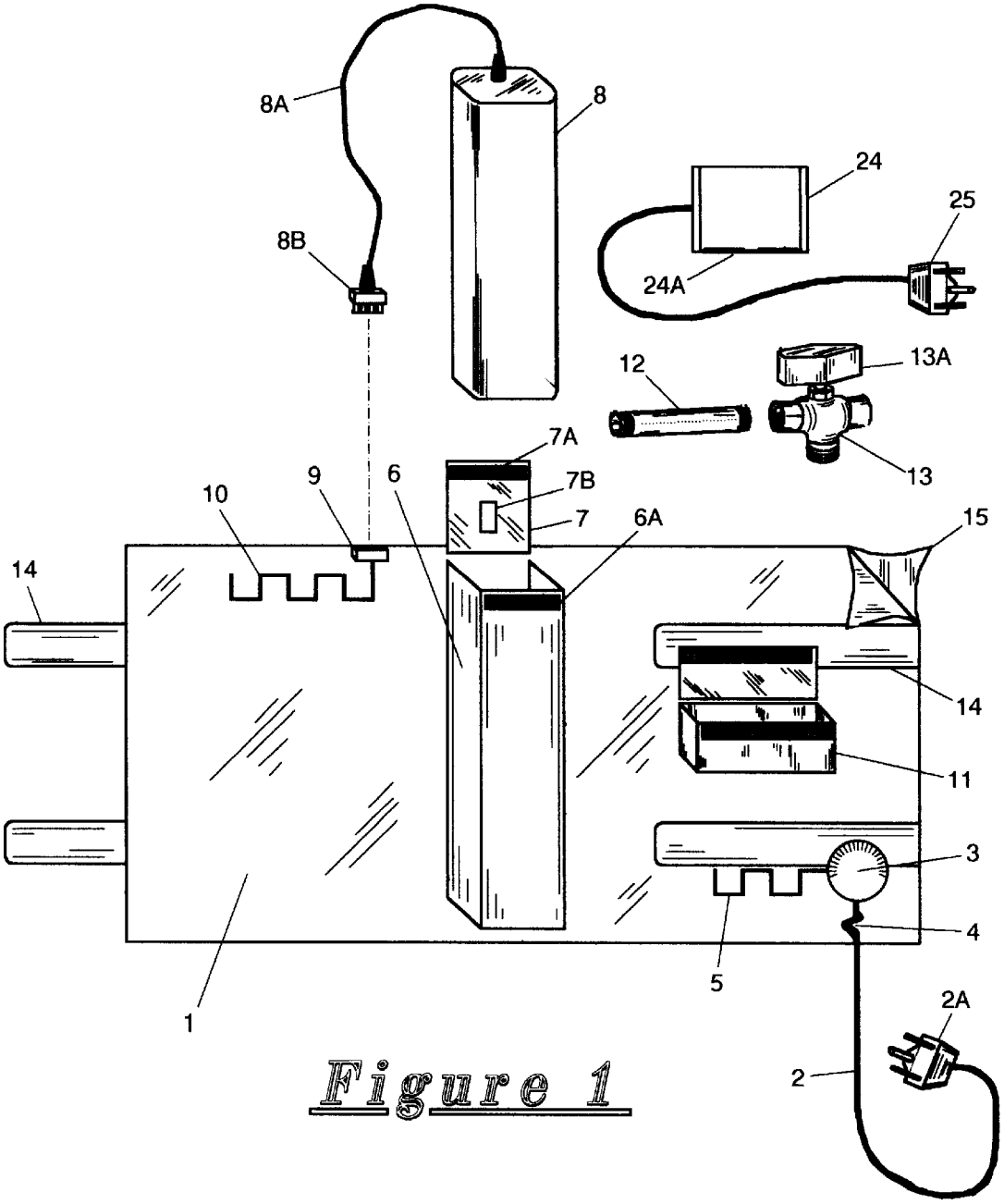
FIG. 1 is a perspective view of a heating device constructed according to the principles of the invention.
Figure 2:
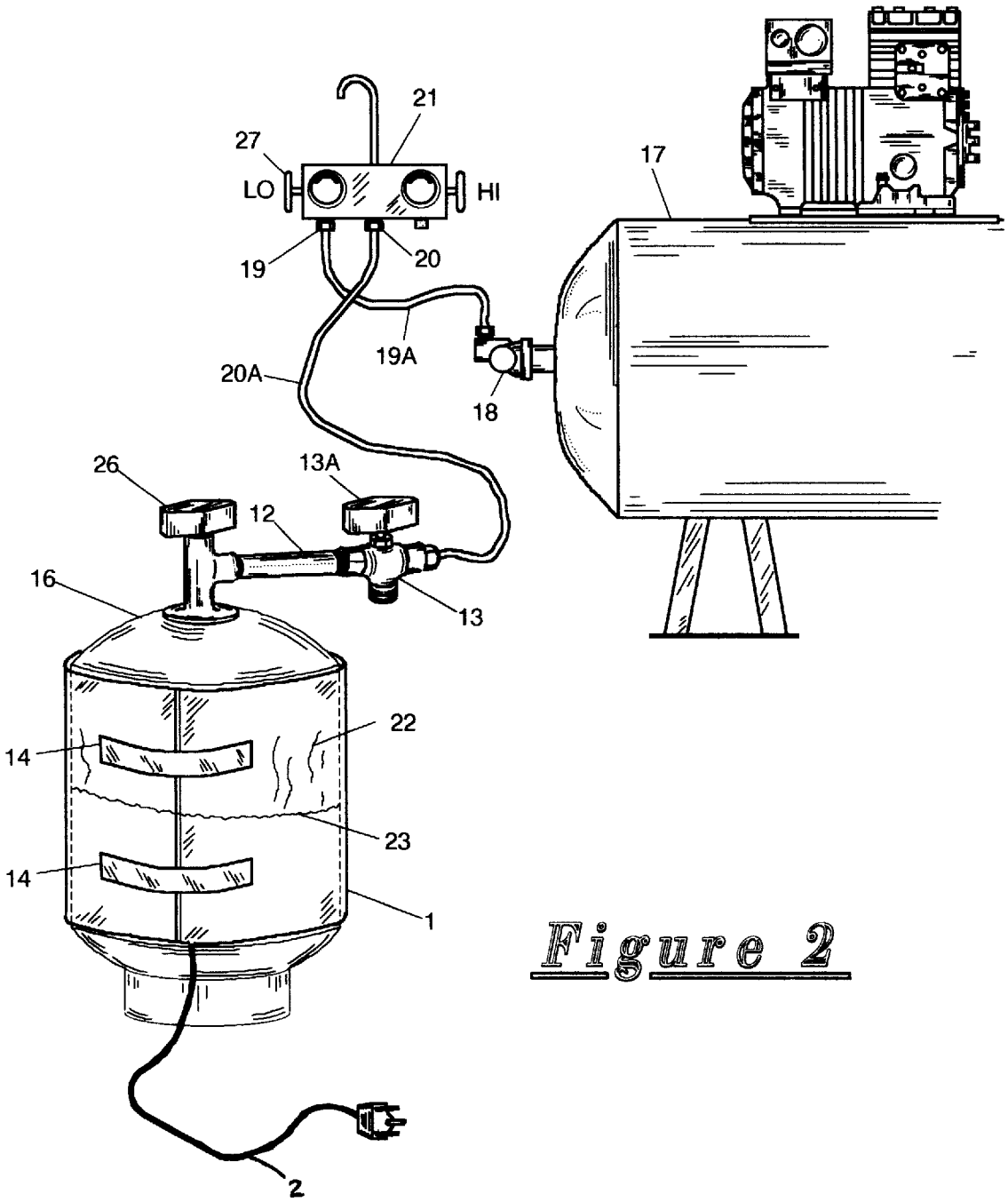
FIG. 2 is an elevational view illustrating a manner of employing the heating device of FIG. 1.

FIGS. 1 and 2 illustrate one embodiment of the invention. The flexible heating jacket 1 is designed with adjustable holders 14 which allow heating jacket 1 to be releaseably engaged to cylinder 16 (shown in FIG. 2). The holders 14 utilize springs, eyelets, lacing hooks, hooks-and-loops, straps, clips, snaps, buckles, and the like and combinations thereof. The holders 14 may be of varying sizes and shapes to conform to various cylinder configurations. Several compartments for carrying a variety of facilitating elements are incorporated in the heating jacket 1 and are discussed below. Of course, the facilitating elements may be attached to the heating jacket 1 or AC cord 2 by a clip or by other known devices. The heating jacket 1 is designed so that it may be rolled into a small diameter and AC cord 2 wrapped and secured so that a minimum amount of space is needed for storage.

The heating system of this invention includes a flexible heating jacket 1 having heating elements 5, 10, which may be etched foil or wire elements (shown in part). The heating elements 5, 10 are compatible with both 12 V, DC and 120 V, AC service and are sandwiched between suitable composites which both seal the heating elements and remain flexible enough to follow the contours of a cylinder so that heat can be conducted from the flexible heating jacket 1 to the cylinder. Such composites include fiberglass reinforced silicon rubber, polyimide films, and the like. The heating elements include inconel, stainless steel, constantan, nickel/iron, and the like.

The heating elements may be powered by both alternating and direct current. AC cord 2 and three prong grounded plug 2A are provided for 120 V alternating current service. A 12 V,DC battery 8 includes DC cord 8A and a DC plug 8B which provides direct current service when engaged with connection 9. The battery 8 is advantageously provided in battery compartment 6 and is held in place by battery compartment lid 7. Battery compartment 6 and battery compartment lid 7 may be joined to heating jacket 1. Battery compartment portion 6A and battery compartment lid portion 7A may be designed for releasable engagement using a variety of mating devices, e.g., springs, eyelets, lacing hooks, hooks-and-loops, straps, clips, snaps, buckles, and combinations thereof, so that the battery is maintained in close proximity to the flexible heating jacket yet can be removed for servicing, re-charging, replacement, or the like. It is preferred that compartment lid 7 have an opening 7B which is large enough so that DC cord 8A may extend through compartment lid 7 and engage connection 9 while being maintained in close proximity to the flexible heating jacket 1.

An internal adjustable thermostat 3 may be added to the electrical circuit of the heating elements 5, 10 to permit control of the amount of power delivered to the heating jacket 1. A fusible link 4, which breaks the circuit above a predetermined thermal limit, may also be added to the electrical circuit of heating elements 5, 10 to protect against failure of the thermostat 3 and overheating of the heating jacket 1.

Carrying compartment 11 provides a holding space for a variety of structural assists. For example, a portable 120 V,AC–12 V,DC transformer 24 with a three prong grounded plug 25 and having 12 V pin connection 24A suitable for engagement with DC plug 8B is provided for re-charging battery 8. Compartment 11 also provides a place to store hose connector 12, pressure relief valve 13, and pressure gauge 13A, which are used during gas transfer to monitor and protect a technician against cylinder or transfer line failure due to over-pressurization.

The operation of the invention is described with reference to FIG. 2. The method of the invention is described in connection with the transfer of refrigerant gas 22 from portable refrigerant cylinder 16 to refrigerant compressor 17, however any type of material in any type of container which may be transferred from one container to another according to the principles of the invention is contemplated. Heating jacket 1 is wrapped around refrigerant cylinder 16 and secured using adjustable holders 14. Cylinder 16 may contain refrigerants or other gases.

The connections needed between cylinder 16 and compressor 17 are described below. Hose connector 12, pressure relief valve 13 and pressure gauge 13A, which are stored in compartment 11, are connected to cylinder 16. Hose connector 12 is attached to cylinder valve 26 of cylinder 16. Pressure relief valve 13 and pressure gauge 13A are attached to hose connector 12. Refrigeration hose 20A is connected between pressure relief valve 13 and connection 20 of refrigerant charging manifold 21. Refrigeration hose 19A is connected to the low pressure connection 19 of refrigerant charging manifold 21, and is connected to suction service valve 18 of compressor 17.

After the above-described connections are made, cylinder valve 26 and refrigerant manifold valve (low pressure side) 27 are opened. Air is then bled from the refrigeration hoses 19A, 20A by loosening the hose connection at suction service valve. After bleeding the air from the hoses, hose 19A is re-tightened to suction service valve 18 of compressor 17 and suction service valve 18 is opened.

If 120 V,AC is available, AC plug 2A of heating jacket 1 is inserted into the AC outlet; otherwise DC plug 8B of battery 8 is inserted into connection 9. Thermostat 3 should be adjusted to a desired level. Heating jacket 1 then heats the cylinder 16 which heats the refrigerant liquid 23 and refrigerant gas 22. The heating increases pressure in the cylinder 16 and thus enables the transfer of refrigerant gas 22 and increases the rate of gas transfer of the refrigerant gas 22.

When the temperature in the cylinder 16 reaches the set point of the thermostat 3 the heating elements 5, 10 will disengage from their electrical circuits. Upon reaching the low temperature differential point the thermostat 3 will reengage the heating elements 5, 10. If the thermostat 3 should fail, a fusible link 4 in series with the heating elements 5, 10 will break the electrical circuit in heating jacket 1.

When the transfer of refrigerant gas 22 is complete, thermostat 3 is turned off and heating jacket 1 is removed from cylinder 16. Valve 26 of the cylinder 16 and valve 18 of compressor 17 are closed and all attachments are disconnected. Hose connector 12 and pressure relief valve 13 are replaced in compartment 11. If necessary, battery 8 may be recharged using transformer 24. Heating jacket 1 may be rolled into a small diameter for storage.

The safety devices of the invention are designed and manufactured in accordance with applicable codes. Pressure relief valve 13 is designed to open if the pressure within the cylinder 16 exceeds the maximum allowable safe working pressure as specified by the manufacturer. The pressure relief valve 13 is designed to have the capacity to prevent a pressure rise of no more that 10 percent of the maximum allowable working pressure of the vessel as specified in the latest edition of ANSI B9.1 Safety Code for Mechanical Refrigeration. Pressure relief valve 13 conforms to the latest edition of Section VIII Unfired Pressure Vessels. The heating jacket 1 and associated components have a UL underwriter laboratories listing and CSA certification.

What is claimed is:

1. Apparatus for facilitating the transfer of gas from a portable cylinder, comprising:

(a) a heating jacket sized to fit over the portable cylinder;

(b) one or more adjustable holders attached to said heating jacket;

(c) a compartment attached to said heating jacket to store facilitating elements; and (d) a pressure relief valve, a pressure gauge, and a hose connector stored in said compartment.

2. The apparatus of claim 1, further comprising an additional compartment attached to said heating jacket to store other facilitating elements.

3. The apparatus of claim 2, further comprising a battery stored in said additional compartment.

4. The apparatus of claim 2, further comprising a battery re-charger stored in said additional compartment.

5. The apparatus of claim 1, further comprising connectors joining said heating jacket to alternating and direct current service.

6. Apparatus for facilitating the transfer of a refrigerant gas from a portable cylinder to a compressor, comprising:

(a) a heating jacket;

(b) one or more adjustable holders attached to said heating jacket; and (c) a pressure relief valve, a pressure gauge, and a hose connector releasably attached to said heating jacket.

7. A method of facilitating the transfer of gas from a portable cylinder to a vessel, comprising the steps of:

(a) providing an apparatus having a heating jacket, one or more adjustable holders attached to the heating jacket, and a pressure relief valve, a pressure gauge, and a hose connector releasably attached to the heating jacket;

(b) connecting the portable cylinder to the vessel;

(c) removing the pressure relief valve from the heating jacket and placing the pressure relief valve between the portable cylinder and the vessel;

(d) placing the heating jacket in contact with the portable cylinder; and (e) heating the portable cylinder so that the gas within the cylinder is transferred to the vessel.

8. The method of claim 7, wherein the removing step further comprises disengaging the pressure relief valve from the heating jacket.

9. The method of claim 7, wherein the heating step employs direct current.

10. The method of claim 7, further comprising the step of controlling the temperature of the heating jacket wherein the temperature of the portable cylinder is indirectly controlled.

11. The method of claim 7, further comprising the step of discontinuing the heating step if the temperature of the heating jacket exceeds a predetermined limit.

12. The method of claim 7, further comprising the step of connecting the pressure gauge between the portable cylinder and the vessel.

13. The method of claim 7, further comprising the step of venting gas through the pressure relief device when an over-pressure condition occurs.

14. The method of claim 7, further comprising the step of re-charging a battery employed to power the heating jacket.

* * * * *